US009567118B2

(12) United States Patent
Rodrigues

(10) Patent No.: US 9,567,118 B2
(45) Date of Patent: Feb. 14, 2017

(54) METHOD OF PRODUCING A PERSONAL CARE PRODUCT CONTAINING A FLUID MIXTURE

(71) Applicant: Ana Lúcia Schmidt Lourenço Rodrigues, Sao Paulo (BR)

(72) Inventor: Ana Lúcia Schmidt Lourenço Rodrigues, Sao Paulo (BR)

(73) Assignee: Ana Lúcia Schmidt Lourenço Rodrigues, Sao Paulo (BR)

( * ) Notice: Subject to any disclaimer, the term of this patent is extended or adjusted under 35 U.S.C. 154(b) by 515 days.

(21) Appl. No.: 14/150,532

(22) Filed: Jan. 8, 2014

(65) Prior Publication Data

US 2014/0116012 A1 May 1, 2014

Related U.S. Application Data

(62) Division of application No. 12/935,134, filed as application No. PCT/BR2009/000085 on Mar. 27, 2009, now Pat. No. 8,640,432.

(30) Foreign Application Priority Data

Mar. 28, 2008 (BR) ..... 0801098

(51) Int. Cl.
*B65B 3/30* (2006.01)
*B65B 3/04* (2006.01)
(Continued)

(52) U.S. Cl.
CPC ..... *B65B 3/30* (2013.01); *B01F 13/1055* (2013.01); *B01F 13/1063* (2013.01);
(Continued)

(58) Field of Classification Search
CPC ..... B65B 3/00; B65B 3/04; B65B 3/10; B65B 3/26; B65B 3/30; B65B 3/305; B65B 3/326; B65B 7/28; B65B 7/2842; B01F 13/1055; B01F 13/1063; B01F 13/1066; B01F 13/1069; B01F 15/00123; B01F 15/00253; B01F 2215/0031; G07F 13/06
(Continued)

(56) References Cited

U.S. PATENT DOCUMENTS 4,258,759 A 3/1981 Achen
4,307,759 A * 12/1981 La Bianca ..... B29C 31/066 141/100
(Continued)

FOREIGN PATENT DOCUMENTS

DE 4110299 C1 * 2/1993 ..... A45D 40/00
EP 1093842 A1 4/2001
(Continued)

OTHER PUBLICATIONS

Oxford English Dictionary definition—Carousel "carousel, n." OED Online. Oxford University Press, Jun. 2016. Web. Jun. 22, 2016.*

*Primary Examiner* — Stephen F Gerrity
(74) *Attorney, Agent, or Firm* — Slater Matsil, LLP

(57) ABSTRACT

An embodiment method includes coupling a first/second flow mouth of a main/secondary valve structure to a first/second compartment containing a selected base liquid/a selected combination substance, and transferring the first/second volume of the selected base liquid/selected combination substance from the first/second compartment via the main/secondary valve structure and a dosing valve to a bottle disposed in a bottling station. After the transferring the first and second volumes to the bottle, the method includes moving the bottle to a mixing station and mixing a content of the bottle to form the fluid mixture, closing the bottle in
(Continued)

a closing station, sealing the bottle in a sealing station, and dispensing the bottle to a user.

11 Claims, 3 Drawing Sheets

(51) Int. Cl.
*G07F 13/06* (2006.01)
*B01F 13/10* (2006.01)
*B65B 7/28* (2006.01)
*B01F 15/00* (2006.01)

(52) U.S. Cl.
CPC .... *B01F 13/1069* (2013.01); *B01F 15/00253* (2013.01); *B65B 3/04* (2013.01); *B65B 7/2842* (2013.01); *G07F 13/06* (2013.01); *B01F 2215/0031* (2013.01)

(58) Field of Classification Search
USPC ..... 53/396, 428, 467, 471, 237, 266.1, 281, 53/283, 284.5, 284.6; 141/9, 100, 105; 222/145.1, 145.7, 145.8
See application file for complete search history.

(56) References Cited

U.S. PATENT DOCUMENTS 4,333,356 A * 6/1982 Bartels et al. ..... B01F 15/0458 137/99
4,871,262 A * 10/1989 Krauss et al. ..... B01F 13/1055 222/135
5,119,973 A 6/1992 Miller et al.
5,163,010 A * 11/1992 Klein et al. ..... A45D 44/00 222/135
5,268,849 A 12/1993 Howlett et al.
5,365,722 A 11/1994 Edwards et al.
5,622,692 A * 4/1997 Rigg et al. ..... A61B 5/442 356/402
5,862,947 A 1/1999 Wiegner et al.
5,903,465 A * 5/1999 Brown ..... A45D 44/005 700/242
6,457,496 B1 * 10/2002 Chuang ..... B01F 13/1058 141/100
6,672,341 B2 1/2004 Bartholomew et al.
6,793,387 B1 9/2004 Neas et al.
7,000,656 B2 2/2006 Todd
7,171,992 B2 * 2/2007 DiGianfilippo et al. ..... G06F 19/3406 141/102
2002/0194021 A1 12/2002 Matsumoto et al.
2003/0010791 A1 * 1/2003 Gentiluomo et al. .. A61J 3/002 221/92
2003/0075233 A1 * 4/2003 Hewlitt et al. ..... B67D 7/74 141/9
2004/0122553 A1 * 6/2004 Phan et al. ..... A45D 44/005 700/233
2005/0092772 A1 5/2005 Miller et al.
2006/0054241 A1 * 3/2006 Bartholomew ..... A61J 3/002 141/105
2006/0086405 A1 * 4/2006 Kaufhold et al. .. B01F 13/1055 141/83
2011/0168293 A1 7/2011 Van Vreeland et al.

FOREIGN PATENT DOCUMENTS

WO WO 9000136 A1 * 1/1990 ..... B65B 3/04
WO WO 9830189 A2 * 7/1998 ..... B01F 13/1055

* cited by examiner

METHOD OF PRODUCING A PERSONAL CARE PRODUCT CONTAINING A FLUID MIXTURE

This patent application is a divisional of non-provisional patent application Ser. No. 12/935,134, filed Sep. 28, 2010, which is a national phase filing under section 371 of international patent application number PCT/BR2009/000085, filed Mar. 27, 2009, which claims priority to Brazil patent application number PI0801098-6, filed Mar. 28, 2008, each of which is incorporated herein by reference in its entirety.

BACKGROUND

As commonly known, numerous cosmetic products are known for the treatment of skin and/or hair, where each one has a different formula, to clean, moisturize, protect or provide many other benefits to the users. However, many persons evidence allergic reaction to certain substances included in the formula of such products, such as, for instance, shampoos or creams. The most frequent reactions are red skin with edema or hives, in addition to the sensations of warmth, burning or itching.

One of the most common causes of allergic reactions are the scents, preservative substances and paraphenyleno diamine, which, when in contact with the skin of people suffering from any kind of allergy, such as rhinitis, asthma, or yet elders and/or children, may cause the described reactions, whether though skin sensitiveness, or through mere contact by smell.

Another important issue regarding the choice of the product resides in the personal preference of each individual, which varies as a consequence of several standards. For instance, the contact of certain scents, oils, etc., for a given type of skin, such as black skin in relation to white or yellow skin, produces different reactions, and can be good for one type of skin and not good for another type of skin. Another point to be considered is that many people need to use a particular kind of component to wash their hair, for instance, to combat dandruff, which many times is not found in the shampoo version they prefer, and must therefore use two types of shampoo, representing an additional cost. In addition, one product may have a scent different from the other. As already known, cosmetics are manufactured in large scale by the industry, where great mixing, bottling and sealing machines are provided, preparing the products as a series, being inspected by chemists in charge.

It is also known that cosmetics and other products in general can be prepared by processing pharmacies, where the customer delivers a prescription prepared by a medical doctor in charge, which is formulated and prepared by a chemist or person in charge of the processing pharmacy, delivering it to the customer. Generally, the cost of this type of product is much higher as compared to the products commonly found in the market prepared by the cosmetic industry.

SUMMARY OF THE INVENTION

Thinking of providing improvements to the consumer market, the inventor has developed a mixing, processing and sealing machine to process substances used to prepare cosmetics and related products. The machine has been developed to offer the user/customer the option of personalizing the user's own cosmetics, such as cleaning, moisturizing and hair protection products, skin protection products, etc., allowing the user to develop the ideal product according to the user's preference. The present machine can be installed in beauty parlors, supermarkets, pharmacies, stores, fairs, hospitals, convenience stores, hotels, brand promotion stands, among so many other places.

In one aspect, the fully automated machine prepares general cosmetics, such as shampoos, creams, moisturizers, toners, deodorants, etc., through the combination of one main substance, such as a base fluid, released by pressing a key on the command keyboard, with other secondary substances such as scents, oils, essences, dyes, vitamins, etc., added to the base fluid by pushing keys or buttons placed in the control keyboard of the machine. The whole mixing process is automated and assisted by a chemist in charge, present at the site or by electronic means, as explained later. The combinations may be pre-scheduled by the machine. Prescriptions and formulations can be prepared by a qualified chemist, that is, each plurality of keys or buttons may be associated with a certain pre-scheduled formulation, or, as an option of the machine, the agent/user may program the machine according to a prescription prepared by a qualified professional, such as dermatologists or other specialists, allowing the obtention of a personalized product, fully adjusted to the user.

After the end of the selection process, the agent/user presses the "start" button which allows the machine to capture the components chosen, the components are agitated to mix the product, and finally a cover seal is affixed, which may be a mere sachet, to a container of approximately 1 liter in size, depending on the client's option and of the characteristics of the machine.

In a preferred construction, the machine equipment provides a plurality of internal compartments, the main compartments, capable of storing one or more gallons or at least two liters containing substances of the "base" type, to prepare, for instance, shampoo, conditioner, moisturizer and other. Other compartments of smaller capacity, called secondary compartments, contain combining substances, such as scents, vitamins, oils, etc.

The main compartments, with the "base" substances, are connected to a valve of a carrousel type, which, is connected to a dosing valve on its side.

The dosing valve receives, through another path, a connection coming from another carrousel, called secondary compartments, responsible for receiving the combined substances. This way, the user, whether or not assisted by a guide, such as a professional of the cosmetic area or a responsible chemist, goes to the machine and chooses, from the control keyboard, the type of product the user prefers which can be based on a prescheduled formula of the equipment or in a formula prescribed by a responsible medical doctor. Once the formula of the desired product is chosen, the equipment's procedures may start. The choice of a personalized shampoo, through the control keyboard, may be as in a practical example, described as follows:

a) the equipment is manually or automatically fed with the size of bottle wanted (250 ml, 500 ml, 1 liter or other measures, without restriction);

b) through the keys, the user chooses the type of product, for instance, shampoo;

c) the desired quantity is chosen;

d) the main carrousel leads the flow opening to the compartment of the shampoo base, and allows the flow of the volume chosen;

e) from the main carrousel, the chosen shampoo volume is conducted to the dosing valve which will receive the shampoo base volume and fill the bottle;

f) the same procedure is done in relation to secondary substances (oils, essences, vitamins, etc.);

g) the secondary carrousel drives the flow mouth to each of the secondary compartments chosen, maintaining the mouth open for a period of time specified by the equipment program;

h) each volume of a secondary substance is conducted to the dosing valve and, consequently, to the bottle which already contains the shampoo base;

i) the bottle is closed with a suitable cover;

j) after being closed, the bottle goes to the mixing device, and is agitated for a given period of time;

k) the bottle with the end product is sealed and released for delivery to the user/customer.

Some characteristic construction points include, for example:

- The compartment to add the base component (Fluid 1) may be an internal part of the machine, and may have a mouth for at least 4 containers with different types of fluids, one of them being water. Such compartments provide for an alarm device informing if the fluid in the container is about to finish, allowing exchange time.
- The containers may be prepared with several materials, preferably made from plastic and the fluid is packed by vacuum, type 2 liters refill, having the product discharge mouth adjustable to the machine's discharge mouth, receiving the product through the valve or by pressure.
- A container such as a water gallon type may be turned upside down so as to release the liquid when the mechanism is activated.
- Addition of the mix/components in the base fluid is chosen through pressing of keys, each key for a mix/component; such keys may preferably contain Braille.
- Tube cleaning pipes: a tube cleaning system by steam and vapor is provided, preparing them for a new formulation; the cleaning is driven automatically immediately after the end of each operation of the machine.
- The driving of the mix and steps performed by the machine, as well as the quantity and type of mix are indicated in a liquid crystal display (LCD) or similar display type.
- The dosing unit comprises an intelligent system to schedule combinations of mix and doses according to the volume of the bottle chosen in milliliters. At the end of the mix injection, the system, through the LCD panel asks "did the operation finish?" Whether the answer is "yes" or "no", the machine may go to the subsequent steps, i.e., agitation and sealing of the bottle.
- Bottling: the nozzle is retractable, that is, it projects itself outside the machine and within the bottling, and returns when the machine is turned off, thus avoiding contamination with the environment.
- The plastic packages are preferably made by vacuum, and when fit into the bottling mouth, inflate with the liquid avoiding any precontamination.
- The agitator or mixer comprises an automatic door closing system (transparent), providing isolation, that may operate during the whole process.
- Eventually, should the agent/user require, the machine may bottle only the main fluids, irrespective of the mix.

As described, an advantage of one aspect of the present equipment is that it allows the manufacture of personalized products, in ideal quantities and according to the individual preference of each user, allowing maximum use of the product, without waste.

Another advantage of one aspect of the present equipment, in addition to the versatility in preparing several products in a practical and fast manner, is that it is easy to install, since it has a medium size, allowing for operation in supermarkets, drugstores, hospitals, convenience stores, hotels, etc. Another advantage is that the present equipment is fully computerized and allows interaction with the agent/user through several types of command, such as keys and buttons, voice command, and/or Braille, among others.

Another advantage related to the intelligent system of the machine is that it provides for a printing or recording device associated with the production of the cosmetic or related product. Such device may print, through a thermal printer or equivalent, the composition chosen by the client or may, in another option, record such composition in a mini-CD, making it easier to do another operation when the client returns to the machine, since it may only be necessary to follow the prescription printed or to introduce the mini-CD in the machine for it to process the product once again.

DESCRIPTION OF THE DRAWINGS

Supplementing the present description so as to achieve a better understanding of the characteristics of the present invention and according to a preferred practical realization thereof, attached hereto is a set of drawings, as example and without limitation, wherein.

DETAILED DESCRIPTION

In one aspect, the present invention covers equipment and corresponding preparation procedures for personalized products of chemical or natural substances used for cosmetics and related products, such as shampoos, creams, toners, moisturizers, liquid soap, deodorants, and oils, among others. The base substance is a fluid to which can be added combining substances, such as essences, scents, dyes, vitamins, oils, etc. Such equipment comprises a sole unit or cabinet of medium size, to be installed in various facilities, such as drugstores, supermarkets, hospitals, convenience stores, and others, that offer the use the option of identifying the user's own cosmetic product. The operation of the cosmetic mixing machine and related materials can be done through the actuation of a key. The fluid base cosmetic is chosen by the agent/customer and a combination of possible mixtures is programmed in advance in the system by a chemist in charge or by an authorized medical doctor (through prescription for instance). The components are delivered to the system of the machines by means of lateral keys. The system allows for computerized adjustment and control and is duly controlled and supervised by a chemist in charge. At the end of the selection process, the agent/customer can press the key to end the process and start agitation to mix the product and finally the product can be sealed.

Figure 1:
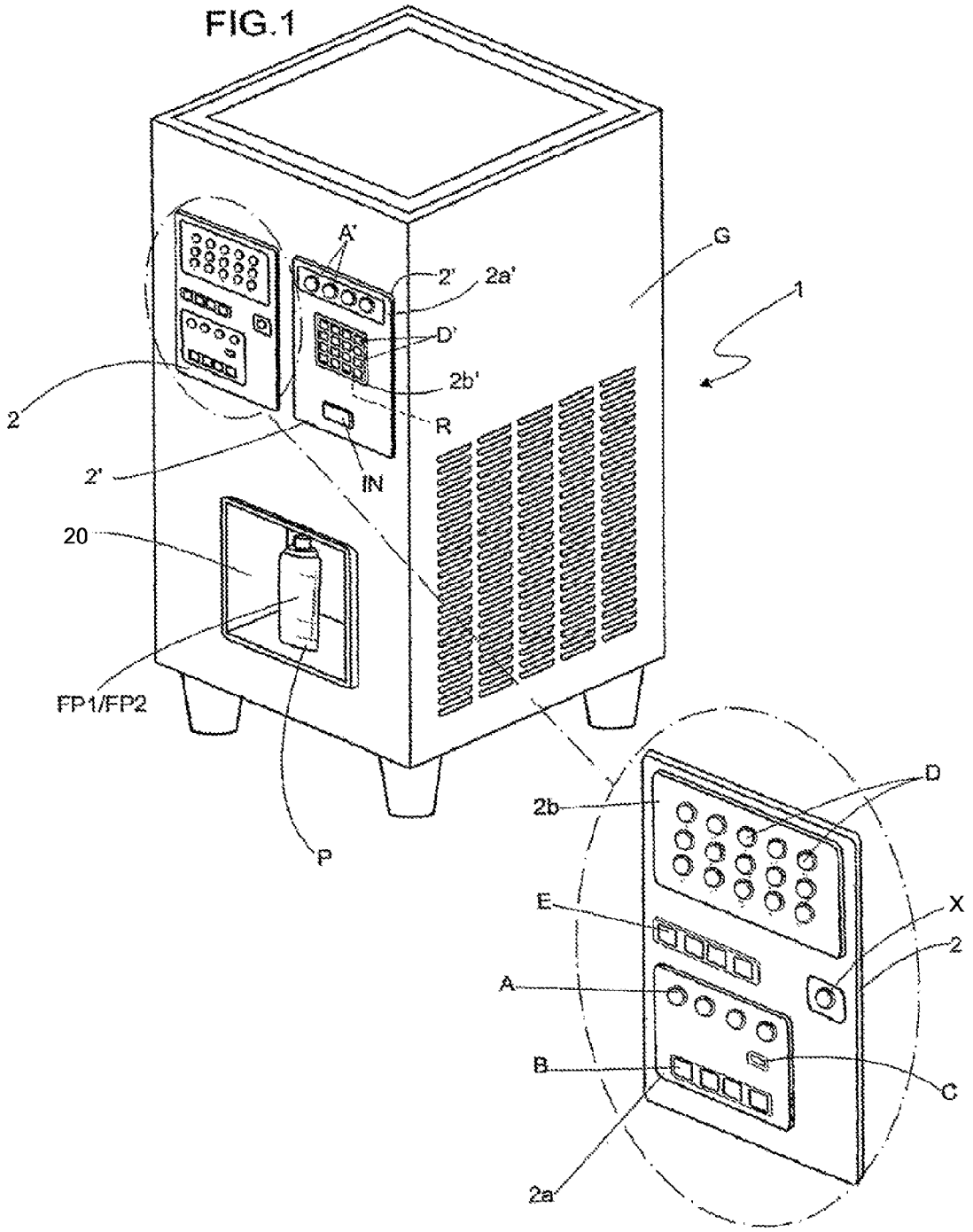
FIG. 1 represents a perspective view of the referred machine and the amplified view of one of the command keyboards.

With reference to the illustrated drawings, embodiments of the present invention refer to a mixing, processing and sealing machine for substances to prepare cosmetics and related materials and corresponding procedures for preparation of cosmetics and related materials. More specifically, FIG. 1 shows a machine (1) for the preparation of cosmetic products (P) and related products. These products may be chemical or natural substances prescribed in formulas which may be based on personalized compositions (FP1), originated from prescriptions from medical professionals, such as dermatologists and/or other specialists or even chosen by the user/customer themselves, assisted by a qualified assistant, or yet other personalized formulas (FP2) resulting from recipes (R) previously programmed by the chemist in charge, which are part of the machine program (1). These formulas (FP1) and (FP2) (collectively (FP)) are specially assigned to allow for the most diversified skin and/or hair treatment. Such equipment (1) allows the user to, with or without the help of a trained assistant, to be able to manufacture the personalized product (P), totally adjusted to the user's preference.

Such equipment (1), in an optional construction encompasses a cabinet (G) equipped with at least one control keyboard (2) and/or (2'), with two similar keyboards (2*a*) and (2*b*) and/or (2*a*') and (2*b*'), all capable of commanding and controlling the internal devices of the cabinet (G). These devices may be defined by a plurality of main compartments (3), capable of warehousing the corresponding gallons (4) containing at least 2 liters of "base" substances (SB) which may, one of them being water, be used to prepare the cosmetics and related products, for instance, shampoo, conditioning, moisturizer, etc. Such compartments (3) have their drives electronically controlled by a programmable logical controller, PLC or another one suitable to act in the corresponding electrical valve releasing the fluid.

Also inside the cabinet (G) are other compartments with lower capacity (secondary compartments—(5)), where there are stored containers (6) with combination substances (SC) such as scents, vitamins, oils, etc. The mouths (4*a*) of main compartments (3), with the "base" substances (SB), are connected by tubes (T1) to a main carrousel (7), equipped with a flow mouth (7*a*). The main carrousel (7) is connected to an entrance (8*a*) of a dosing valve (8). The bottle (F) is assembled in the bottling station (EN) and the end product (P) is prepared. The dosing valve (8), which is controlled by an intelligent system to program combinations of mix and doses according to the volume of the bottle chosen in milliliters, receives, through another tube (T2) and another entrance (8*b*), a connection originating from a secondary carrousel (9). The secondary carousel (9) is responsible for receiving the combination substances (SC) through the access mouth (9*a*). The dosing valve (8) is equipped with the retractable nozzle (8*c*), which is projected outside upon the bottling, and retracts upon the end of the bottling, avoiding contamination with the environment.

Figure 2:
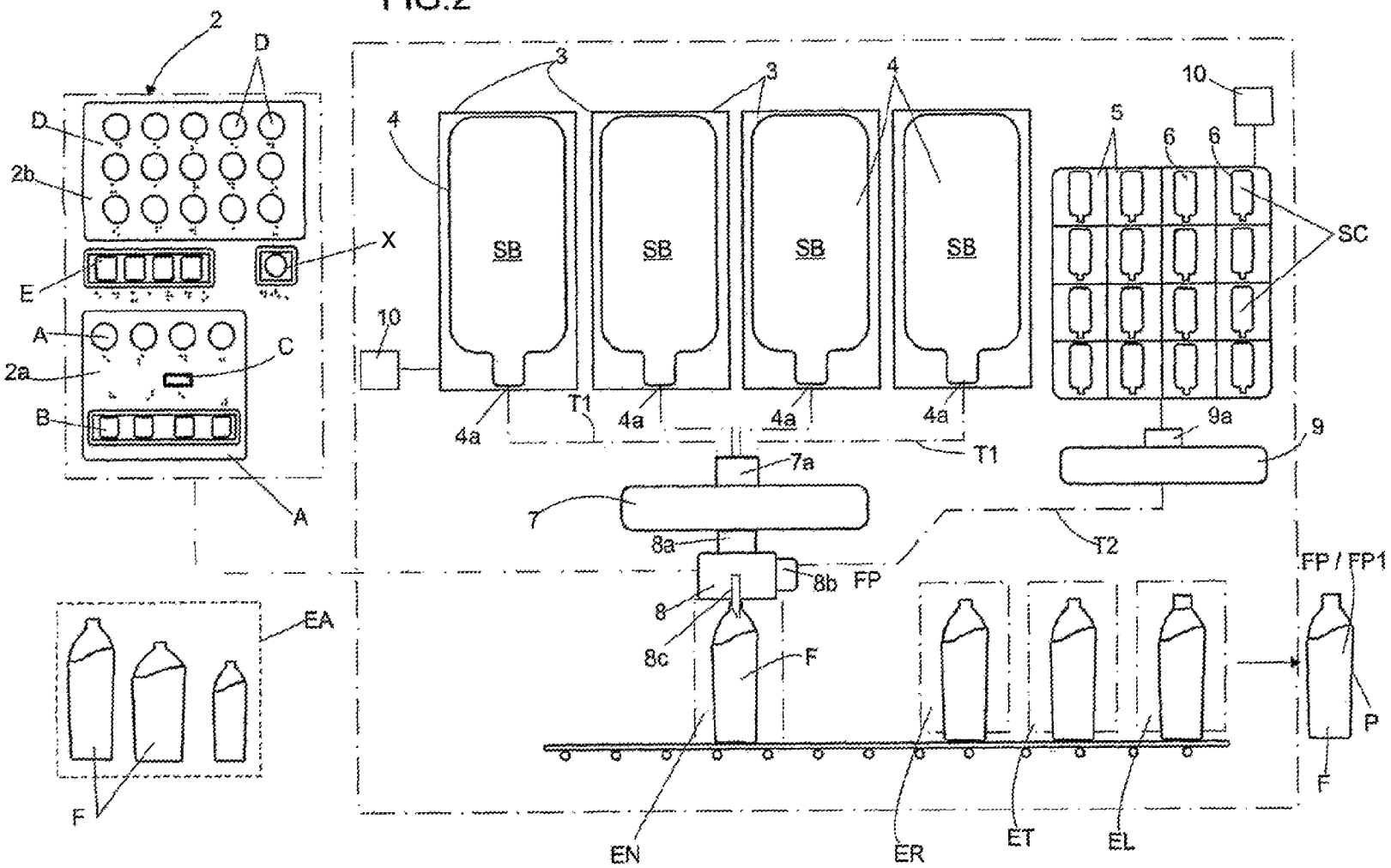
FIG. 2 illustrates a scheme of the internal part of the equipment and the devices responsible for preparing the personalized end product.

Compartments (3) and (5) are equipped with alarm devices (10) (see FIG. 2) which inform when the fluids of each container (4) or (5) are close to requiring a change.

The equipment also provides, internally or externally, a mixing station (ER), a closing station (ET) and a sealing station (EL), and provides bottle dispensing station (20).

The equipment (1) may provide for an internal or external compartment, called a feeding station (EA) where the several models of bottles (F) will be warehoused, since the bottling and product preparation program allows the user/customer to choose the volume of product to be prepared, which may vary from 100 ml to 1 liter, or a volume range not restricted to the examples of the present embodiment. The production process performed by the equipment (1) to obtain a cosmetic or related product (P) may be as follows: a) the bottling station (EN) of the equipment (1) is fed manually or automatically with a bottle (F) chosen among the optional volumes; b) at the keyboard (2*a*) the user chooses from the keyboard (2), through the keys (A), the type of base substance (SB) and with the keys (B), the volume to be fed into the bottle (F); c) a key is pressed (C) ending the keyboard command (2*a*); d) from the keyboard (2*b*) keys (D) of keyboard (2), the types of combination substances (SC) which the user wishes to add to the base (SB); e) through keys (E) of keyboard (2*b*) one chooses the volume of the combination substance (SC) to be added to the base substance (SB); a key is pressed (x), ending the choice process and automatically starts the preparation by the equipment; f) the main carrousel (7) leads the flow opening mouth (7*a*) up to the compartment of the base substance (SB) chosen in the keyboard (2*a*); g) from the main carrousel (7), the volume of base substance (SB) is taken to the dosing valve (8) and, consequently, to bottle (F) placed in the bottling station (EN); h) the secondary carrousel (9) makes the same procedures as carrousel (7), taking the flow mouth (9*a*) to the combination substances (SC) chosen, allowing their flow by the tubes (T2) up to the dosing valve (8) and from that to the bottle (F) in the bottling station (EN); i) the bottle, containing all portions of the base substances (SB) and combination substances (SC) is taken to the mixing station (ER); j) the bottle is closed in the closing station (ET); and k) finally, the bottle is sealed and released in the sealing station (EL) being released for delivery to the user/customer. Optimally, a command keyboard (2') may be provided, previously programmed with some formulas prepared by the chemist in charge. This panel (2') encompasses a keyboard (2*a*') with keys (A') in a number corresponding to the number of compartments (3) and corresponding base substances a keyboard (2*b*') with keys referring to a given type of recipe (R), previously scheduled, with are available, together with the equipment, for the user/customer to be able to access before choosing.

At keyboard (2') it is sufficient for the user/customer to choose, through key (A'), which type of base substance (SB) the user wishes and through key (D') which ready recipe (R), based in the combination substances (SC) (vitamin, dandruff combat, essences, etc.) the user wishes to incorporate to the base (SB). After making such choices, the start key (IN) is pressed, for the equipment to proceed to prepare the product (P), such as described in the following process steps: a1) the bottling station (EN) of the equipment (1) is fed manually or automatically with a bottle (F) chosen among the optional volumes; b2) in the keyboard (2'), more precisely in the sub-panel (2*a*'), one chooses through key (A'), the type of base substance (SB) to be placed in the bottle (F); c1) from keys (D') of the sub-panel (2*b*') one chooses the pre-programmed recipe (R) the types of combination substances (SC) which one wishes to add to the base (SB); d1) key (IN) is pressed, ending the selection process and automatically starting the preparation of steps "g" to "m" of equipment preparation, already described.

Figure 3:
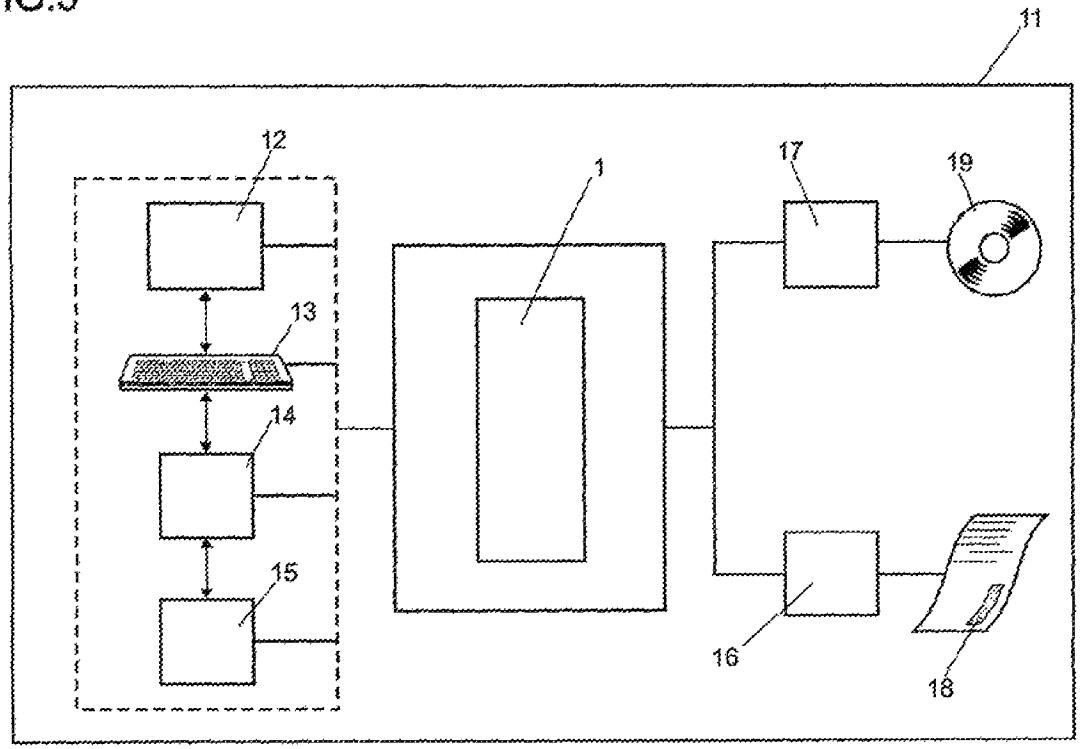
FIG. 3 illustrates a block diagram of the intelligent program or 'software' to drive the machine, as well as the peripheral devices associated thereto.

As stated, the machine works by means of an automated programming control, that is, 'software'; (11) (FIG. 3) especially developed to allow the 'step by step' operation made by the agent/user to make the combination and doses of the mix components.

For such purpose, the 'software' of controller (11) provides for the following operational conditions:

To start the programming, a sheet or slip or similar element is introduced in a driving device (12), responsible for starting the machine; a device which is turned off if the facility so prefers, since this device can be added remotely by means of a keyboard (13) where the customer data may be inserted: name, (note that the machine is linked to the individual identification and that it is important for the person to keep the person's individual formula).

The controller may contemplate driving through 'voice command' (14) allowing short people or handicapped people in wheel chairs to access the machine.

The voice command may be associated with a keyboard or Braille keys (15) allowing access by persons who are short sighted or blind.

After the machine (1) is started through any of the devices (12/13/14/15 or other suitable devices) the agent/user starts the automated operation of the machine's internal devices (1).

At the end of the operation, the controller (11) may be connected to a printing device (16) or recording device (17) responsible for recording the formula of the cosmetic or related material, chosen by the agent/user. The printing device (16) may print a slip with the characteristics of the formula as well as the condensation in bar codes (18) or may, in another option, through the recording device (17), record such composition in a mini-CD (19), making a new operation easier when the client returns to the machine, since it will be enough to repeat the printed prescription or introduce it by means of the bar code or through the mini-CD in the machine for the client to obtain the same product once more.

A mixing, processing and sealing machine for substances to prepare cosmetics and related materials and corresponding procedures for preparation of cosmetics and related materials of the type used to mix, process (shake) and bottle products of the type using means to mix, process (shake) and bottle products, more specifically characterized by the fact of the machine (1) driven by external means (12), (13), (14), (15) or another suitable means and electronically commanded by an intelligent program or "software" comprising a cabinet (G) where there are externally placed command keyboards (2) and (2') and a bottling station (EN). Internally, there are provided a plurality of devices (DP) used by one agent/user to prepare cosmetics (P) and related products, to be placed in bottles (F), as of the choice of chemical or natural substances which may be in the form of base substances (SB) and combination substances (SC), prescribed in personalized formulas (FP1), originated from prescriptions of professionals or other specialists or formulas (FP2), resulting from previously programmed recipes (R) which are part of the equipment program (1); at the end of the machine operation (1). The 'software' (11) may be connected to a printing device (16) or recording (17) responsible for recording the formula of the cosmetic or related product, chosen by the agent/user. The printing device (16) may print an evidence with the characteristics of the formula, as well as the condensation into bar code (18) or may, in another option, through the recording device (17), record such composition in a mini-CD (19) or equivalent.

A mixing, processing and sealing machine for substances to prepare cosmetics and related materials and corresponding procedures for preparation of cosmetics and related materials in a preferred construction, characterized by the cabinet (G) of equipment (1) being equipped with at least one command keyboard (2), with two similar keyboards (2*a*) and (2*b*), capable of commanding and controlling the internal devices (DP), which are constituted by a plurality of main compartments (3), capable of warehousing corresponding gallons (4) containing at least 2 liters of substances of the 'base' type (SB), such as shampoos, moisturizers, creams, etc. In another part of the interior of the cabinet, there are arranged other compartments of lower capacity, called secondary compartments (5), where there are stored containers (6) of combination substances (SC), such as scents, vitamins, oils, etc. The main compartments (3), with the 'base' substances (SB), are connected by tubing (T1) to a main carrousel (7), equipped with a flow mouth (7*a*). Such main carrousel (7) is connected to the entrance (8*a*) of a dosing valve (8), duly assembled in the bottling station (EN) of the bottle (F); said dosing valve (8) receives, through another entrance (8*b*), the connection originated from a secondary carrousel (9), responsible for receiving the combination substances (SC) through an access mouth (9*a*). The equipment also provides, internally or externally, a mixing station (ER), the closing station (ET) and the sealing station (EL). Such equipment (1) may provide for an internal or external compartment, the feeding station (EA) where there are warehoused the several models of bottles (F), since the bottling and preparation program of the product (P) allows the user/customer to choose the volume of product to be prepared, which may vary from 100 ml to 1 liter or other suitable volume.

A mixing, processing and sealing machine for substances to prepare cosmetics and related materials and corresponding procedures for preparation of cosmetics and related materials characterized by the dosing valve (8) being controlled by an intelligent system to program mix and dosing combinations according to the volume of the bottle chosen in milliliters. Such a dosing valve (8) is equipped with the retractable nozzle (8*c*), which is projected outside upon the bottling, and retracts upon the end of the bottling.

A mixing, processing and sealing machine for substances to prepare cosmetics and related materials characterized by compartments (3) and (5) being equipped with alarm devices (10), which inform when the fluids of each container (4) or (5) are close to require change.

Procedures for preparation of cosmetics and related material are characterized by the production process performed by the equipment (1) to obtain cosmetic or related product (P) based in formulations (FP1) originated from a medical doctor or specialist, being commanded in a command panel (2) according to the following steps: a) the packing stations (EM) of equipment (1) is manually or automatically fed with a bottle (F), chosen among the option volumes, which one wants to fill in; b) one chooses, in panel (2), precisely in sub-panel (2*a*) through key (A) the type of base substance (SB) and through key (B) the volume to be filled to the bottle (F); c) key (C) is pressed, ending the panel command (2*a*); d) through keys (D) of sub-panel (2*b*) one chooses the types of combined substances (SC) which; one wishes to add to the base (SB), e) through keys (E) of the sub-panel (2*b*) one chooses the volume of combined substance (SC) to be added to the base substance (SB); f) key (x) is pressed, ending the choice process and automatically starts the preparation of the equipment; g) the main carrousel (7) leads the flow opening mouth (7*a*) up to the compartment of the base substance (SB) chosen in the keyboard (2*a*); i) from the main carrousel (7), the volume of base substance (SB) is taken to the dosing valve (8) and, consequently, to bottle (F) placed in the bottling station (EN); j) the secondary carrousel (9) makes the same procedure, leading the flow mouth (9*a*), to the combination substances chosen, allowing their flow to the dosing valve (8) and from that to the bottle (F) in the bottling station (EN); k) the bottle, containing all portions of the base substances (SB) and combination substances (SC) is taken to the mixing station (ER); 1) the bottle is closed in the closing station (ET); and m) finally, the bottle is sealed and released in the sealing station (EL) being released for delivery to the user/customer.

A mixing, processing and sealing machine for substances to prepare cosmetics and related materials and corresponding procedures for preparation of cosmetics and related materials in an optional construction, is characterized by the cabinet provided with a command keyboard (2') for the preparation of formulas (FP2) resulting from previously programmed recipes (R). This panel (2) comprises one sub-panel (2*a*') with keys (A') in number corresponding to the number of compartments (3) and corresponding base substances (SB) one sub-panel (2*b*') with keys (D'), related to a given type of recipe (R) which contemplates the addition of certain combination substances (EC) recipes (R) which are available, beside the equipment, for the user/customer to have access thereto before the choice.

Procedures for preparation of cosmetics and related material, characterized by the production process performed by the equipment (1) to obtain a cosmetic or related product (P) which formula (FP2) results from recipes (R) typed to the panel (2'), observing the following steps: a1) the bottling station (EM) of the equipment (1) is fed manually or automatically with a bottle (F) chosen among the optional volumes, which one intends to fill; b2) in the keyboard (2'), more precisely in the sub-panel (2*a*'), one chooses through key (A'), the type of base substance (SB) to be placed in the bottle (F); c1) from keys (D') of the sub-panel (2*b*') one chooses the pre-programmed recipe (R) the types of combination substances (SC) which one wishes to add to the base (SB); d1) Key (IN) is pressed, ending the choice process and automatically starts the preparation of steps "g" to "m" of equipment preparation, already described.

It is obvious that, when embodiments of the present invention are placed in use, there may be introduced modifications regarding certain construction details and form, however this will not imply departure from the essential principles which are clearly outlined by the appended claims, being thus understood that the terms used have the purpose of describing without limitation.

What is claimed is:

1. A method of producing a personal care product containing a fluid mixture, the method comprising:

coupling a first flow mouth of a main valve structure to a first compartment containing a selected base liquid;

transferring a first volume of the selected base liquid from the first compartment via the main valve structure and a dosing valve to a bottle disposed in a bottling station;

coupling a second flow mouth of a secondary valve structure to a second compartment containing a selected combination substance;

transferring a second volume of the selected combination substance from the second compartment via the secondary valve structure and the dosing valve to the bottle while the bottle remains disposed in the bottling station;

after the transferring the first and second volumes to the bottle, moving the bottle to a mixing station and mixing a content of the bottle to form the fluid mixture;

closing the bottle in a closing station; and sealing the bottle in a sealing station and dispensing the bottle to a user.

2. The method of claim 1, before the couplings and the transferrings, further comprising generating a fluid mixture formula based on key commands entered at a command panel selecting a pre-programmed recipe.

3. The method of claim 2, the generating the fluid mixture formula further comprising:

receiving, at the command panel, a first entry selecting the selected base liquid;

receiving, at the command panel, a second entry selecting the pre-programmed recipe designating the selected combination substance; and receiving, at the command panel, a third entry initiating the couplings and transferrings.

4. The method of claim 1, before the coupling and transferring, further comprising generating a fluid mixture formula based on key commands entered at a command panel selecting a formulation originated by a specialist.

5. The method of claim 4, the generating the fluid mixture formula further comprising:

receiving, at the command panel, a first entry selecting the selected base liquid;

receiving, at the command panel, a second entry selecting the first volume of the selected base liquid;

receiving, at the command panel, a third entry selecting the combination substance, receiving, at the command panel, a fourth entry selecting the second volume of the selected combination substance; and receiving, at the command panel, a fifth entry initiating the couplings and transferrings.

6. The method of claim 1, before the couplings and the transferrings, further comprising reading a formula or prescription of the user in bar code format to determine a recipe for the fluid mixture.

7. The method of claim 1, further comprising moving a selected bottle from the bottling station to adjacent the dosing valve.

8. The method of claim 1, further comprising recording on computer-readable media a formula of the personal care product chosen by the user.

9. The method of claim 1, further comprising printing a formula of the personal care product chosen by the user.

10. The method of claim 1, wherein the transferring the first volume and the transferring the second volume further comprise:

projecting a retractable nozzle of the dosing valve into the bottle;

dispensing the first volume into the bottle; and dispensing the second volume into the bottle; and retracting the retractable nozzle of the dosing valve from the bottle.

11. The method of claim 1, wherein the selected base liquid is water, and wherein the selected combination substance comprises one or more of a scent, a vitamin, an oil, and a dye.

* * * * *